United States Patent [19]

Tanaka et al.

[11] 4,423,828

[45] Jan. 3, 1984

[54] GOODS DISCHARGE MECHANISM AND GOODS STORAGE AND DISCHARGE SYSTEM OF AUTOMATIC VENDING MACHINE

[75] Inventors: Nobuyasu Tanaka, Yokkaichi; Hiroshi Tominaga, Higashi-inamachi; Minoru Fujita, Ooyasumachi; Hajime Tanaka, Yokkaichi; Takahisa Hattori, Tsu; Akira Yasuda, Yokkaichi; Shigeya Kato, Suzuka, all of Japan

[73] Assignee: Fuji Electric Company, Ltd., Kawasaki, Japan

[21] Appl. No.: 284,956

[22] Filed: Jul. 20, 1981

[51] Int. Cl.[3] ..... G07F 11/04

[52] U.S. Cl. ..... 221/129; 221/131; 221/298

[58] Field of Search ..... 221/6, 11, 14, 129, 221/131, 67, 289, 295, 297, 298

[56] References Cited

U.S. PATENT DOCUMENTS 3,348,733 10/1967 Johnson ..... 221/129 X
3,613,945 10/1971 Rockola et al. ..... 221/295
3,831,806 8/1974 Lindsey ..... 221/14 X

*Primary Examiner*—F. J. Bartuska
*Attorney, Agent, or Firm*—Brumbaugh, Graves, Donohue & Raymond

[57] ABSTRACT

An arrangement is disclosed for reducing the overall effective size of the goods storage and discharging system in an automatic vending machine. The solenoid and transmission mechanism of each goods discharging mechanism are so disposed that the discharging mechanisms of adjacent goods storage shelves may be arranged in a back-to-back relation with the solenoids and transmission mechanisms thereof laterally adjacent each other. The overall size of the vending machine may thus be substantially reduced.

9 Claims, 11 Drawing Figures

GOODS DISCHARGE MECHANISM AND GOODS STORAGE AND DISCHARGE SYSTEM OF AUTOMATIC VENDING MACHINE

BACKGROUND OF THE INVENTION

1. Technical Field

The present invention relates generally to a goods discharging mechanism and goods storage and discharging system of an automatic vending machine having a serpentine type goods storage shelf, and more particularly, to a goods discharging mechanism and a goods storage and discharging system of an automatic vending machine having a plurality of goods storage shelves arranged in parallel rows, and for diminishing the space required for the mounting of the goods storage shelves.

2. Description of the Prior Art

In a conventional arrangement of an automatic vending machine having goods storage shelves of a serpentine type, a plurality of goods storage shelves are disposed from the front to the back of the machine and in parallel relationship. Each storage shelf has a winding (serpentine) goods passage for receiving and storing a multiplicity of cylindrical goods in a rolling condition. A goods discharging mechanism is generally disposed at the lower end of each goods discharging passage. The combination of the goods storage shelves and the goods discharging mechanisms are sometimes referred to as the goods storage and discharging system.

The goods discharging mechanism as a constituent of the goods storage and discharging system generally includes a solenoid, a transmission mechanism and first and second retainer members which are adapted to be alternately extended into and retracted from the associated goods passage. The first and second retainer members are adapted to retain the lowermost good and the good second from the lowermost good, respectively, when they are extended.

There is an increasing demand for automatic vending machines capable of accomodating a large quantity of goods. To this end, recently, it is required to add one more row of goods storage shelves, i.e. to mount 4 (four) shelves in one vending machine. Also, it is desirable to keep the size of the automatic vending machine to a minimum, due to a restriction of the installation space. To this end, it is effective to reduce the overall thickness of the goods discharging mechanism disposed in adjacent rows of the goods storage shelf to thereby diminish the space required for the mounting of the storage shelves.

Among the constituents of the goods discharging mechanism installed between adjacent rows of goods storage shelves, the solenoid occupies a comparatively large space. However, if the solenoid is to achieve its required function, there is a practical limit to which the size of the solenoid may be reduced. Therefore, usually, the thickness of the goods discharging mechanism is determined by the height of the solenoid, which imposes a limit in diminishing the installation space of the goods storage shelves and, hence, the size of the automatic vending machine as a whole.

SUMMARY OF THE INVENTION

In light of the foregoing, the major object of the present invention is to provide a goods discharging mechanism and a goods storage and discharging system which do not require substantial installation space even when the solenoid is rather large.

According to the invention, the solenoid and transmission mechanism of each goods discharging mechanism are disposed at one side, with two goods discharging mechanisms arranged in the space between two adjacent goods storage shelves. Accordingly, space is saved for installation of goods storage shelves which in turn reduces the overall size of the automatic vending machine.

Numerous other advantages of the present invention will become apparent from the following detailed description of the invention and embodiments thereof, from the claims and from the accompanying drawings.

BRIEF DESCRIPTION OF THE DRAWINGS

FIG. 5B-1 shows the arrangement of the goods storage and discharging mechanism of a conventional arrangement;

FIG. 5B-2 shows the arrangement of the goods storage and discharging mechanism of the invention;

DETAILED DESCRIPTION OF THE PREFERRED EMBODIMENTS

Figure 1:
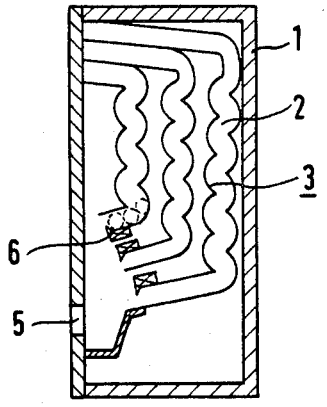
FIG. 1 PRIOR ART
FIG. 1 is a schematic sectional view of a conventional goods storage and discharging system.

FIG. 1 shows the general arrangement of a typical automatic vending machine having goods storage shelves of a serpentine type.

Referring to FIG. 1, the body 1 of an automatic vending machine has three parallel goods storage shelves 3 disposed from front to back and each having a winding goods passage 2. A multiplicity of cylindrical goods are stored in a rolling condition in each goods passage 2. A reference numeral 6 denotes a goods discharging mechanism disposed at the lower end of each goods discharging passage.

The combination of the goods storage shelves and the goods discharging mechanisms will be referred to as a goods storage and discharging system to which the present invention pertains.

Hereinafter, a preferred embodiment of the present invention will be described with reference to FIGS. 2–5 in which the same reference numerals are used to denote the same parts or members as those of FIG. 1.

First, the construction of each goods discharging mechanism will be explained with specific reference to FIGS. 2A and 3, which show the goods discharging mechanism in a stand-by state. In these Figures, the goods discharging mechanism 6 is illustrated to include a solenoid 7, a transmission mechanism 8, a first retainer member 9 and a second retainer member 10. These constituents are carried by a base plate 4 which serves also as the goods transfer surface 4*a* (See FIG. 2A) of the goods passage. The solenoid 7 and the transmission mechanism 8 are disposed at the left side of the central axis A of the base plate 4. (See FIG. 3) The first and second retainer members 9 and 10 are disposed to extend across the central axis A and over the entire width of the base plate 4. A reference numeral 7*a* designates the movable core of the solenoid.

The transmission mechanism 8 includes a connecting plate 13 connected at one end to the movable core 7*a* by a pin 12, and a push-up piece 15 is connected to the other end of the connecting plate 13 by a pin 14.

The push-up piece 15 is V-shaped with its central portion supported by a stationary hub 16 fixed to the base plate 4 so as to rotate around the axis of the hub 16. The push-up piece 15 carries at its end opposite to the pin 14 an engaging pin 17 for engagement with the second retainer member 10.

A tension spring 18, which is retained at its one end by the pin 14 and at its other end by the base plate 4, serves to bias, through the medium of the connecting plate 13, the movable core 7*a* in the direction opposite to the direction of attraction by the solenoid 7.

The first retainer member 9 is supported at its one end by a stationary hub 19 fixed to the base plate 4, so that member 9 can rotate around the axis of the hub 19 and move into and out of the lower portion of the goods passage 2, designated as the space 11 adjacent the goods transfer surface 4*a* of the base plate 4. The first retainer member 9 has an engaging piece 20 formed integrally therewith and adapted for engagement with the engaging pin 14 of the push-up piece 15.

The engaging piece 20 is provided with two engaging surfaces 20*a*, 20*b* adapted for engagement with the pin 14. In the stand-by state shown in FIG. 2A, the engaging surface 20*a* engages the pin 14 so as to support the first retainer member 9 while the latter is projected beyond the goods transfer surface 4*a* into the space 11. A curve B illustrates the locus of movement of the pin 14. The engaging surface 20*b* is disposed at an inclination to the vertical when engaged by the pin 14. (See FIG. 2B.)

The second retainer member 10 is supported at its one end by a stationary hub 21 fixed to the base plate 4, so that member 10 can rotate around the axis of the hub 21, and move into and out of the space 11. The second retainer member 10 is provided with a projection 22 adapted for engagement with the engaging pin 17 of the push-up piece 15.

Reference numerals 4*b*, 4*c* denote openings formed in the base plate 4 to permit the first and the second retainer members 9, 10 to be projected into the space 11 beyond the goods transfer surface 4*a*. The lowermost good and the good second from the lowermost good are designated by reference numerals 23 and 23*a*, respectively.

Figure 2A:
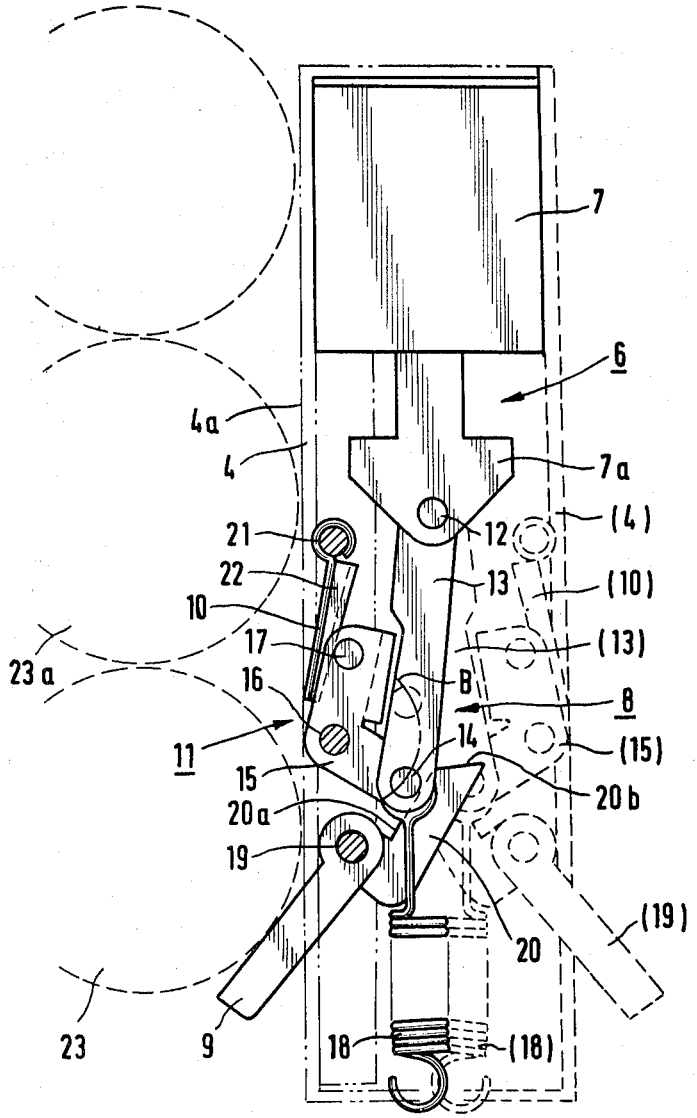
FIGS. 2A and 2B are side elevational views of goods discharging mechanism in accordance with the present invention.

In operation, when the selling command is issued during the state shown in FIG. 2A, the solenoid 7 is energized to attract the movable core 7*a* and overcome the force of the tension spring 18. As the movable core 7*a* is attracted, the connecting plate 13 is moved accordingly to cause a rotation of the push-up piece 15. As a result of the rotation of the push-up piece 15, the engaging pin 17 of the push-up piece 15 lifts up the second retainer member 10 to project the same into the space 11 beyond the goods transfer surface 4*a* into engagement with the good 23*a*, which is second from the lowermost good. (See FIG. 2B.)

The pin 14 of the connecting plate 13 slides on the engaging surface 20*a* of the engaging piece 20 of the first retainer member 9 and leaves the engaging surface 20*a*. Consequently, the first retainer member 9 loses its support so that it is rotated as it is pushed by the good 23 behind the goods transfer surface 4*a*. Meanwhile, the lowermost good 23 is discharged in the direction of the arrow C.

In this state, the first retainer member 9 is prevented from being further rotated behind the surface 4*a* because the engaging surface 20*b* is adapted to be engaged by the pin 14 of the connecting plate 13.

After the completion of the discharge of the lowermost good 23, the solenoid is de-energized to permit the movable core 7*a* to be retracted by the force of the tension spring 18 back to the position illustrated in FIG. 2A. Consequently, the first retainer member 9 is moved to the position beyond the goods transfer surface 4*a* as it is pushed by the pin 14 of the connecting plate 13, while the second retainer member 10 is returned to the position beneath the goods transfer surface 4*a* as the support provided by the pin 17 is removed.

Consequently, the second good 23*a* is released by the second retainer member 10 to be pushed by the following goods into contact with the first retainer member 9. The good 23*a* then becomes the lowermost good.

In the goods discharging mechanism 6 thus constructed, the solenoid 7 and the transmission mechanism 8 are disposed at one side (left side in FIG. 3) of the central axis A of the base plate 4. Therefore, even when two goods discharging mechanisms are arranged in a back-to-back relation as illustrated in FIGS. 2A and 3, the second mechanism being shown by broken line and numerals in ( ), both mechanisms can accomplish the discharging operation without fail.

Figure 4:
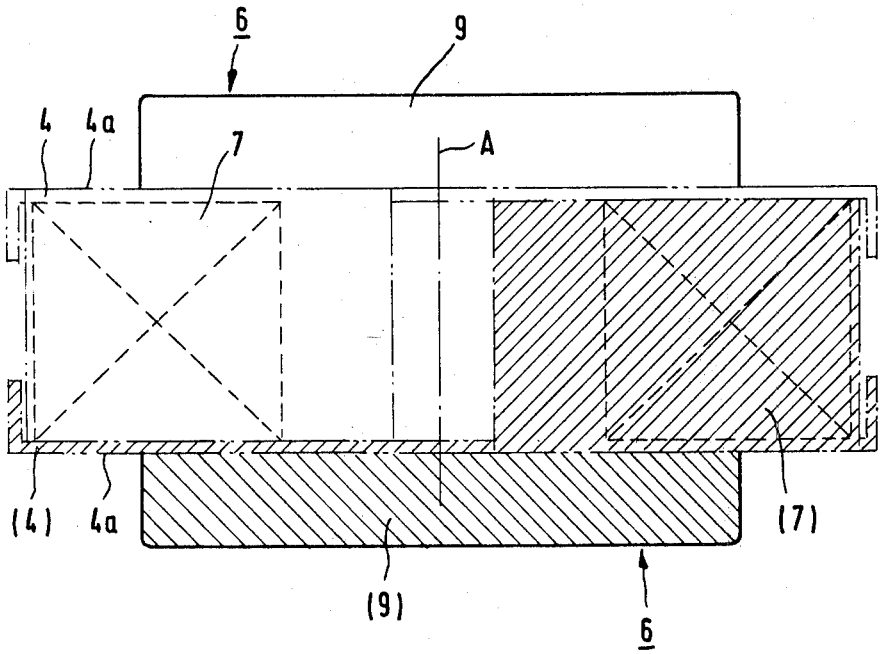
FIG. 4 is a plan view of the goods discharging mechanisms shown in FIG. 2A.

FIG. 4 shows a plan view of such a back-to-back arrangement. For ease of understanding, one of the goods discharging mechanisms is hatched and the parts of the hatched mechanism are denoted by reference numerals in ( ).

Thus, in the goods storage and discharging system of the invention, two goods discharging mechanisms 6 are arranged in a back-to-back relation between adjacent rows of goods storage shelves, such that the transmission mechanisms 8 and the solenoids 7 of two mechanisms are laterally adjacent to each other.

Figure 5A:
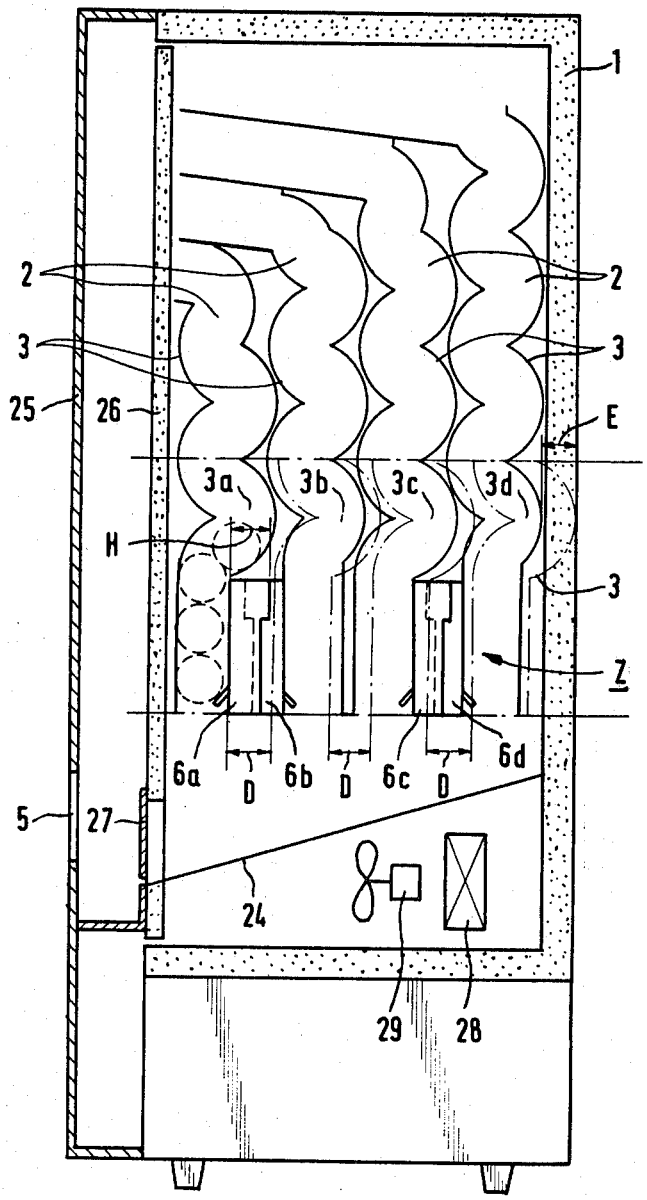
FIG. 5A is a schematic sectional view of a goods storage and discharging system of the invention.

A detailed description will be made with reference to FIG. 5A, in which the same reference numerals are used to denote the same parts or members as those used in FIGS. 2A and 2B. In the automatic vending machine shown in FIG. 5A, there are provided 4 (four) rows of goods storage shelves 3*a*, 3*b*, 3*c*, 3*d* disposed from front to back within the body 1 of the vending machine.

Two goods discharging mechanisms 6*a*, 6*b* are disposed between the goods passages 2 of two adjacent goods storage shelves 3*a*, 3*b* in a back-to-back relation. Also, two goods discharging mechansims 6*c*, 6*d* are disposed between the goods passages 2 of two adjacent goods storage shelves 3*c*, 3*d* in a back-to-back relation. The goods discharging mechanism 6*a* is positioned in the vicinity of the goods passage 2 of the goods storage shelf 3*a*, while the goods discharging mechanism 6*b* is positioned in the vicinity of the goods passage 2 of the goods storage shelf 3*b*. The mechanisms 6*c* and 6*d* are disposed in the vicinity of the goods passages of the good storage shelves 3*c*, 3*d*, respectively.

A reference numeral 24 denotes a chute common for all goods storage shelves 3 and is adapted to guide the goods discharged by the discharging mechanisms 6 toward the outlet 5 provided in the front panel.

The automatic vending machine further has an inner door 26, a thief-proof door 27, a cooler 28 and a blower 29 for circulating chilled air.

In the goods storage and discharging system Z for automatic vending machine constructed in accordance with the invention, the storage shelves occupy a much smaller space as compared with the conventional arrangement.

Namely, in the conventional automatic vending machine, the goods storage shelves are mounted in a manner shown in phantom, so that only one goods discharging mechanism 6 is disposed between two adjacent goods storage shelves. In this case, it is necessary to provide a mounting space D corresponding to the depth H of the goods discharging mechanism 6 in each of the spaces between adjacent goods storage shelves 3. Therefore, if the conventional arrangement of the goods discharging mechanisms is used, it is necessary to provide an additional installation space as denoted by E, resulting in a correspondingly increased overall size of the automatic vending machine.

Figure 5B:
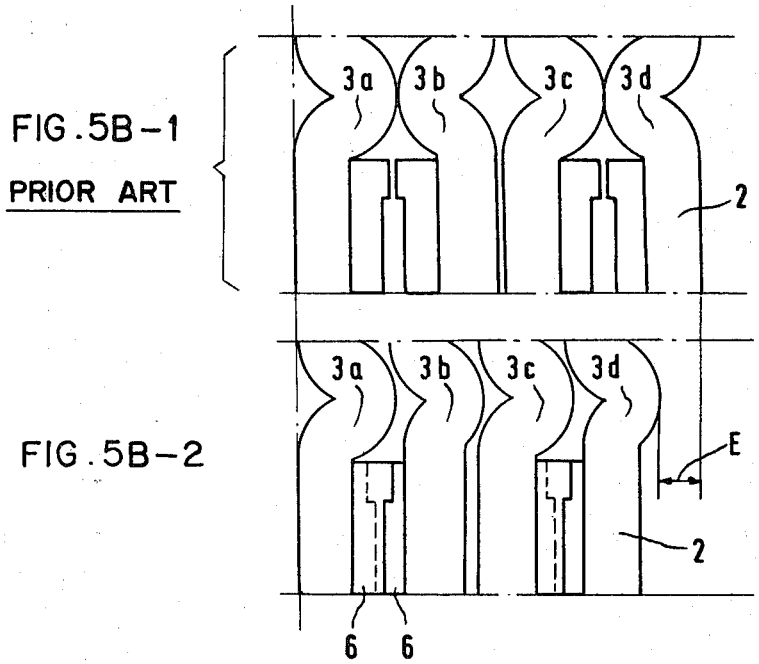

FIG. 5B-1 shows a conventional arrangement in which the conventional goods discharging mechanisms are arranged in a back-to-back relation.

FIG. 5B-2 shows the arrangement of the goods discharging mechanisms of the invention disposed in a back-to-back and laterally adjacent relation. It will be seen that the additional space E is required in the conventional arrangement. In other words, the goods storage and discharging system of the invention requires a smaller installation space for the goods storage shelves than do conventional systems.

Figure 2B:
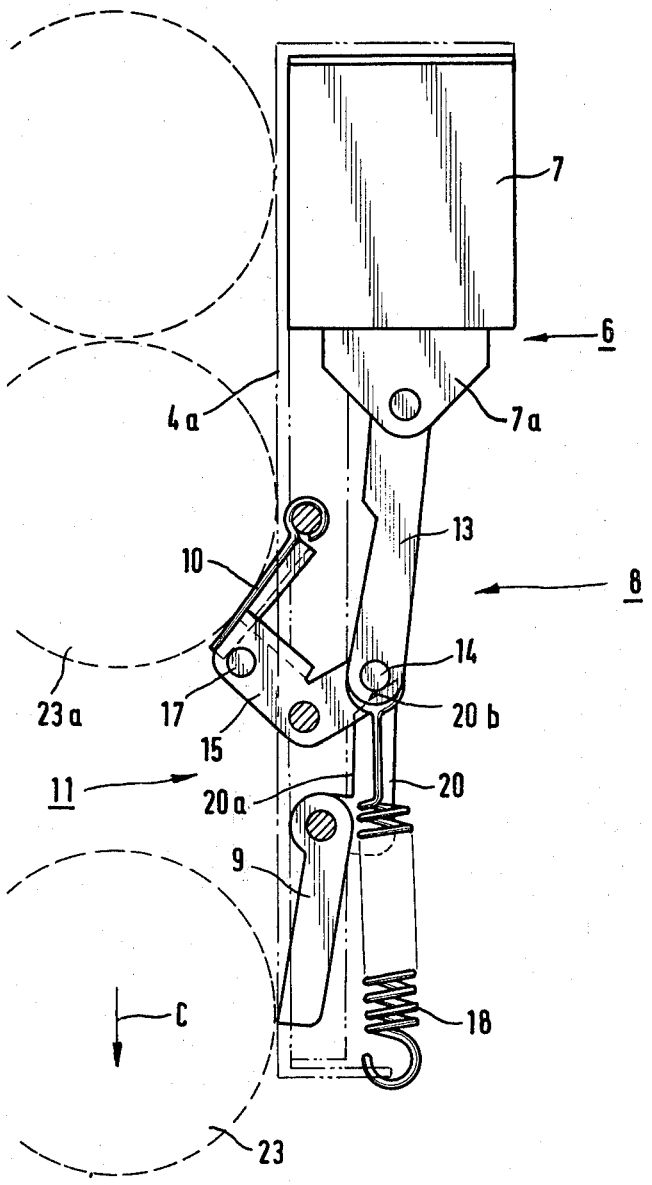
Figure 3:
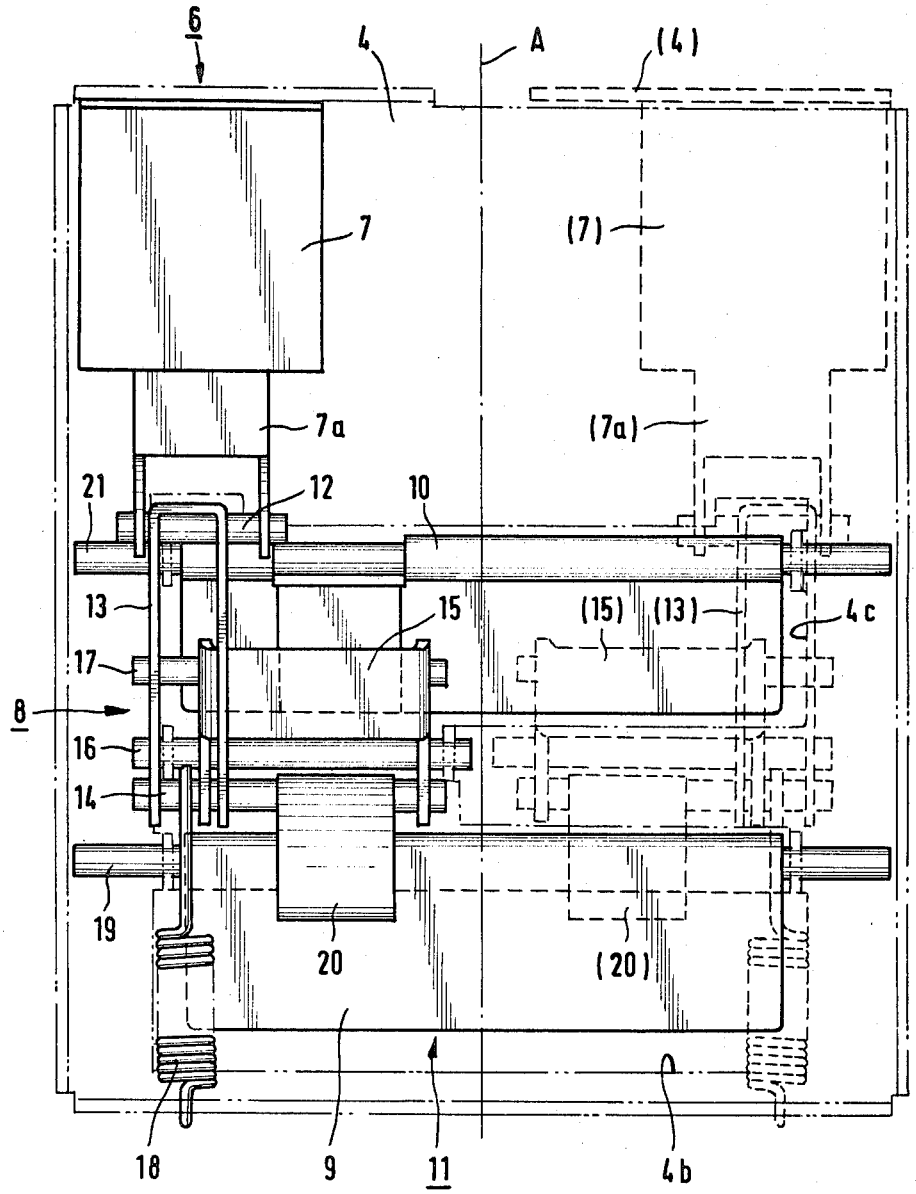
FIG. 3 is a rear elevational view of the mechanisms shown in FIG. 2A.
Figure 6A:
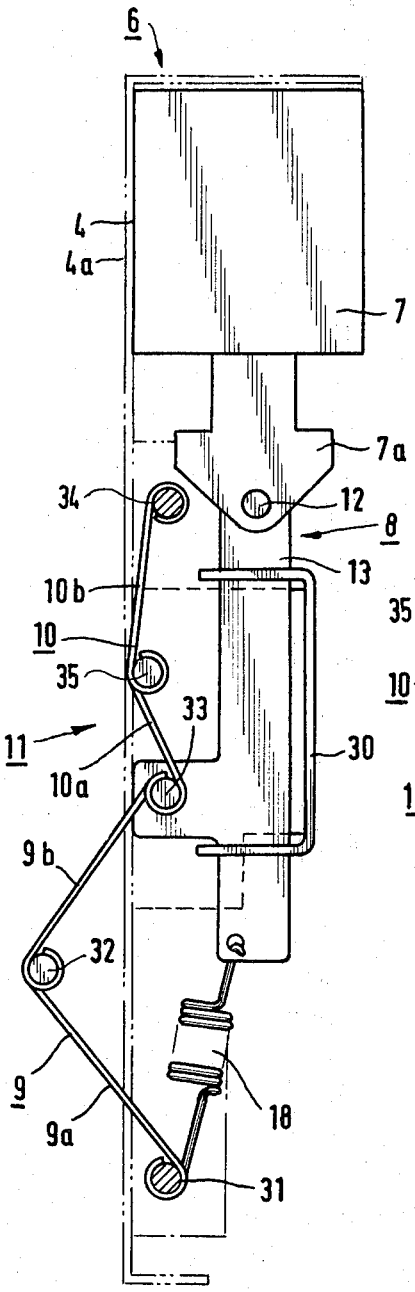
FIGS. 6A and 6B are side elevational views of another goods discharging mechanism in accordance with the invention.
Figure 6B:
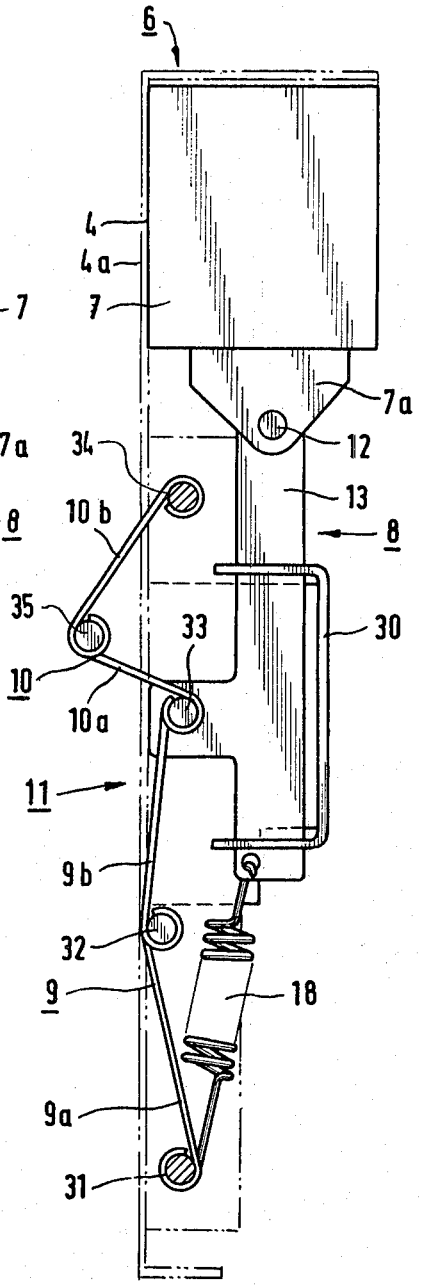
Figure 7:
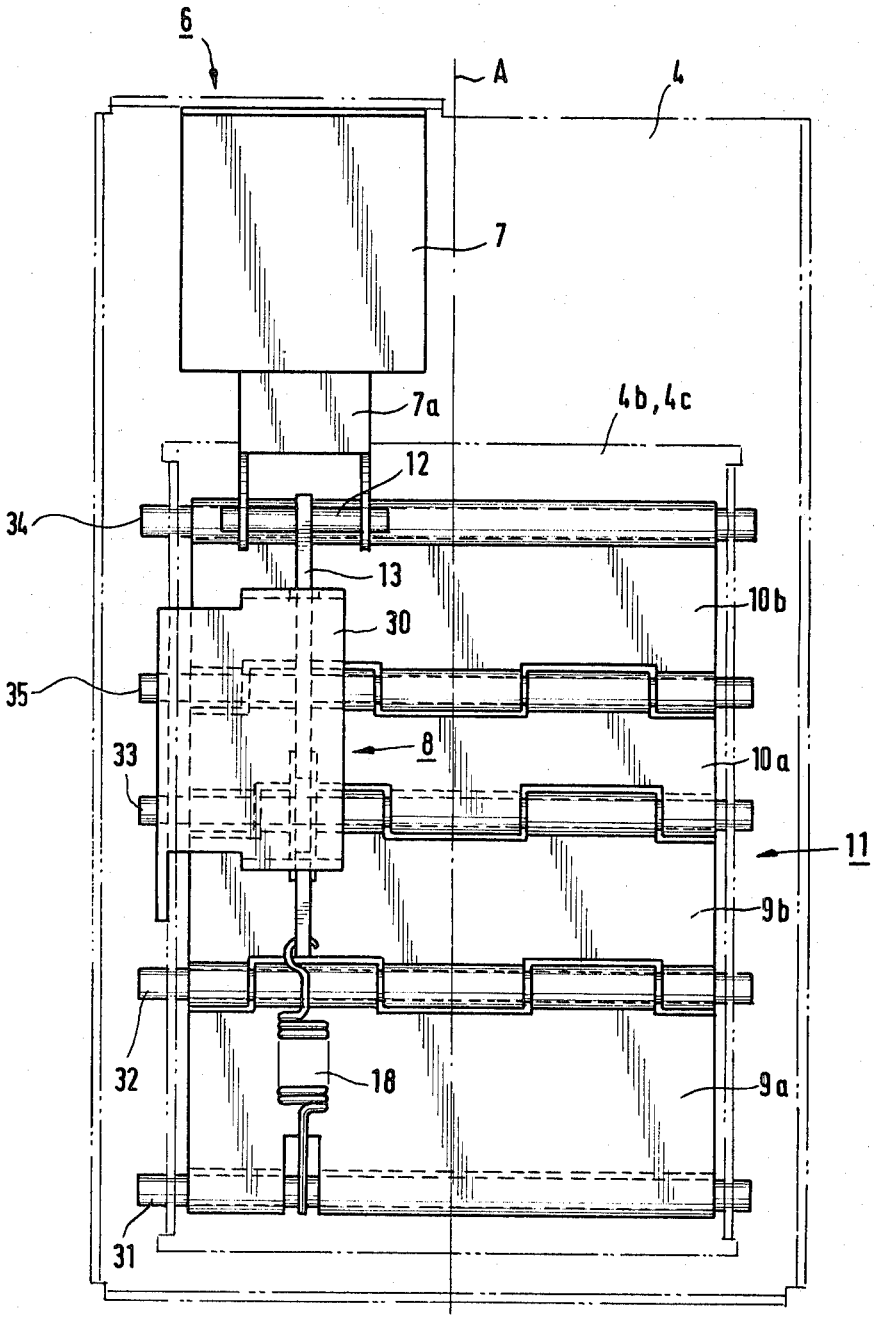
FIG. 7 is a rear elevational view of the goods discharging mechanism shown in FIGS. 6A and 6B.

The goods discharging mechanism of the goods storage and discharging system of the invention may also be constructed in the manner shown in FIGS. 6A, 6B, and 7, in which the same reference numerals are used to denote the same parts or members as those in FIGS. 2A, 2B and 3.

In FIGS. 6A, 6B, and 7, the solenoid 7 and the transmission mechanism 8 are arranged at one side of the central axis A of the base plate 4, as in the case of the goods discharging mechanism shown in FIG. 3. (See FIG. 7)

The transmission mechanism connected to the movable core 7*a* includes a T-shaped connecting plate 13. A reference numeral 30 designates a guide plate for the connecting plate. This guide plate is fixed to the base plate 4 and slidably holds the connecting plate.

The first retainer member 9 is formed by two plates 9*a*, 9*b*. The plate 9*a* is pivotally connected at its lower edge to a stationary hub 31 fixed to the base plate 4, while its upper edge is pivotally connected to the lower edge of the other plate 9*b* by a common pin 32, such that the first retainer member 9 may be flexed about the pin 32. The upper edge of the plate 9*b* is pivotally connected to a pin 33 which is carried by the connecting plate 13. The second retainer member 10 is formed by two plates 10*a*, 10*b* which are assembled between the pin 33 and a stationary hub 34 with a common pin 35 in the same manner as the plates 9*a*, 9*b* of the first retainer member 9.

According to this arrangement, when the solenoid is energized during the state shown in FIG. 6A, the movable core 7*a* is attracted as shown in FIG. 6B to cause an upward movement of the connecting plate 13.

As the connecting plate 13 moves, the pin 33 is moved correspondingly to make the second retainer member 10 project into the space 11 beyond the goods transfer surface 4*a* while retracting the first retainer member 9, to thereby permit the lowermost good to be discharged. After the dispensing or discharging of the good, the solenoid is deenergized so that the state shown in FIG. 6A is resumed due to the action of the spring 18. This goods discharging mechanism can be used in the same manner as that in the embodiment shown in FIG. 5A.

As has been described, according to the invention the solenoid and the transmission mechansim of each goods discharging mechanism are disposed at one side, and two goods discharging mechanisms are arranged in the space between two adjacent goods storage shelves. It is therefore possible to reduce the space for installation of the goods storage shelves which in turn contributes to the reduction of the size of the automatic vending machine as a whole.

From the foregoing, it will be observed that numerous variations and modifications may be effected without departing from the true spirit and scope of the novel concept of the invention. It is to be understood that no limitation herein is intended or should be inferred. It is, of course, intended to cover by the appended claims all such modifications as fall within the scope of the claims.

We claim:

1. In an automatic vending machine having a vertically extending goods passage of a goods storage shelf, said goods passage being adapted to store cylindrical goods in a rolling condition; a goods discharge mechanism disposed in the vicinity of the lower end of said goods passage and being adapted to discharge said goods one by one in accordance with a discharging command, comprising:

a first retainer member adapted to be extended into and retracted from said goods passage so as to engage, when extended, the lowermost good to prevent the latter from being discharged;

a second retainer member adapted to be extended into and retracted from said goods passage so as to engage, when extended, the second lowermost good to prevent said second lowermost good and following goods from being discharged;

a solenoid having a movable core adapted to be attracted by said solenoid and biased in the direction opposite to the direction of the attraction;

a transmission mechanism adapted to transmit the movement of said solenoid to both of said retainer members so as to alternately move said retainer members into and out of said goods passage;

and wherein the portion of each retainer member adapted to engage said goods has a width substantially equal to the corresponding dimension of said goods but a depth less than about one-half the depth of the transmission mechanism and solenoid, and wherein the width of said transmission mechanism and said solenoid are less than about one-half the width of said retainer member and are disposed at one side of said goods passage, so that when two discharging mechanisms are arranged in back-to-back relation, said transmission mechanisms and said solenoids of said discharging mechanisms are laterally adjacent each other and so that the distance between adjacent goods storage shelves is about equal to the depth of one transmission mechanism and associated solenoid.

2. Apparatus as set forth in claim 1 wherein the first and second retainer members are each pivotally mounted at one end at a fixed position so that the other end of each retainer member can be extended into and be retracted from said goods passage.

3. Apparatus as set forth in claim 2 wherein the transmission mechanism comprises:

a connecting plate having a first end pivotally connected to the movable core, and a second end; and a linkage member pivotally mounted generally about its center, wherein one end of the linkage member is pivotally attached to the second end of the connecting plate, and wherein the other end of the linkage member is adapted to engage the second retainer member, whereby movement of the movable core causes the second retainer member to be moved into and out of said goods passage.

4. Apparatus as set forth in claim 2, wherein the transmission mechanism comprises:

a connecting plate having a first end pivotally connected to the movable core and a pin extending from the second end of the connecting plate, and wherein an engaging piece is fixedly attached to said first retainer member and has engaging surfaces adapted to engage the pin of the connecting plate, whereby movement of the movable core causes the first retainer member to be moved into and out of said goods passage.

5. Apparatus as set forth in claim 1 wherein each of said first and second retainer members comprises two plates, with the upper edge of the lower plate for each retainer mechanism being pivotally connected to the lower edge of the upper plate of that retainer mechanism, and wherein the upper edge of the upper plate of the first retainer mechanism is coupled to the lower edge of the lower plate of the second mechanism.

6. In an automatic vending machine having a plurality of goods storage shelves each having a vertically extending goods passage adapted to store cylindrical goods in a rolling condition, said shelves being arranged in parallel rows; a plurality of goods discharging mechanisms disposed in the vicinity of lower ends of said goods passages of respective goods storage shelves and adapted to discharge the goods one by one in accordance with a discharging command, wherein each of said goods discharging mechanisms comprises:

a first retainer member adapted to be extended into and retracted from the associated goods passage so as to engage, when extended, the lowermost good to prevent the latter from being discharged;

a second retainer member adapted to be extended into and retracted from said goods passage so as to engage, when extended, the second lowermost good to prevent said second lowermost good and following goods from being discharged;

a solenoid having a movable core adapted to be attracted by said solenoid and biased in the direction opposite to the direction of the attraction; and a transmission mechanism adapted to transmit the movement of said movable core to both of said retainer members so as to alternately move said retainer members into and out of said goods passage;

and wherein the portion of each retainer member adapted to engage said goods has a width substantially equal to the corresponding dimension of said goods but a depth less than about one-half the depth of the transmission mechanism and solenoid, and wherein the width of said transmission mechanism and said solenoid are less than about one-half the width of said retainer member and are disposed at one side of the associated goods passage, said goods discharging mechanisms of adjacent goods storage shelves being arranged in a back-to-back relation with the transmission mechanism and the solenoids thereof being laterally adjacent to each other and so that the distance between adjacent goods storage shelves is about equal to the depth of one transmission mechanism and associated solenoid.

7. In an automatic vending machine having a vertically extending goods passage of a goods storage shelf, said goods passage being adapted to store cylindrical goods in a rolling condition; a goods discharge mechanism disposed in the vicinity of the lower end of said goods passage and being adapted to discharge said goods one by one in accordance with a discharging command, comprising:

a first retainer member having two plates and adapted to be extended into and retracted from said goods passage so as to engage, when extended, the lowermost good to prevent the latter from being discharged;

a second retainer member having two plates and adapted to be extended into and retracted from said goods passage so as to engage, when extended, the second lowermost good to prevent said second lowermost good and following goods from being discharged;

wherein the upper edge of the lower plate for each retainer mechanism is pivotally connected to the lower edge of the upper plate of that retainer mechanism, and wherein the upper edge of the upper plate of the first retainer mechanism is coupled to the lower edge of the lower plate of the second mechanism;

a solenoid having a movable core adapted to be attracted by said solenoid and biased in the direction opposite to the direction of the attraction;

a transmission mechanism adapted to transmit the movement of said solenoid to both of said retainer members so as to alternately move said retainer members into and out of said goods passage;

wherein the portion of each retainer member adapted to engage said goods has a width substantially equal to the corresponding dimension of said goods, and wherein said transmission mechanism and said solenoid are disposed at one side of said goods passage, so that when two discharging mechanisms are arranged in back-to-back relation, said transmission mechanisms and said solenoids of said discharging mechanisms are laterally adjacent each other.

8. Apparatus as set forth in claim 7 wherein the transmission mechanism comprises a connecting plate connected to the movable core, said connecting plate being pivotally connected to the lower edge of the lower plate of the second mechanism and to the upper edge of the upper plate of the first mechanism, whereby attraction of said movable core by said solenoid causes the second retainer member to be extended into said goods passage and the first retainer member to be retracted from said goods passage, and whereby movement of the movable core in a direction opposite to the direction of attraction causes the first retainer member to be extended into said goods passage and the second retainer member to be retracted out of said goods passage.

9. Apparatus as set forth in claim 8 wherein the upper edge of the upper plate of the first retainer mechanism is pivotally connected to the lower edge of the lower plate of the second mechanism by pin means, and wherein the pin means is carried by said connecting plate.

* * * * *